United States Patent [19]

Chamberlin et al.

[11] 3,990,843

[45] Nov. 9, 1976

[54] METHOD FOR BLEACHING RAW COTTON AND COTTON TEXTILES

[75] Inventors: Thomas A. Chamberlin; L. Wayne White, both of Midland, Mich.

[73] Assignee: The Dow Chemical Company, Midland, Mich.

[22] Filed: Aug. 5, 1974

[21] Appl. No.: 494,445

[52] U.S. Cl. ..... 8/108; 252/187 R; 8/107

[51] Int. Cl.[2] ..... D06L 3/06

[58] Field of Search ..... 8/108, 108.5

[56] References Cited

UNITED STATES PATENTS 3,619,349 11/1971 Liebergott et al. ..... 8/109 X

FOREIGN PATENTS OR APPLICATIONS 2,327,771 12/1973 Germany

*Primary Examiner*—Carman J. Seccuro

*Attorney, Agent, or Firm*—L. Wayne White

[57] ABSTRACT

A method of bleaching cotton is described herein which comprises contacting said cotton with a bleaching solution of chlorine monoxide in an inert liquid solvent (e.g. methyl chloroform). Bleaching occurs very rapidly by this method and the cotton fibers undergo very little if any degradation.

9 Claims, No Drawings

METHOD FOR BLEACHING RAW COTTON AND COTTON TEXTILES

BACKGROUND OF THE INVENTION

The cotton and textile industries recognize a need for bleaching cotton prior to its use in textiles and other areas. The object of bleaching such cotton fibers are, of course, to remove natural and adventitious impurities with the concurrent production of substantially whiter material.

The "bleaching" process in the textile industry actually consisted of two separate processes: (1) scouring, or the removal of wax from the cotton fibers, and (2) bleaching, or the addition of a bleaching agent to actually destroy the color matter present in and/or on the cotton. Efficient bleaching imparted to the cotton goods a pure and "permanent" white color, and, it improved the level-dying properties without tendering or diminishing the tensile strength of the cotton fiber. As used hereafter, the term bleaching shall mean the addition of a bleaching agent to actually destroy color matter present in and/or on the cotton.

There have been two major types of bleach used in the industry. One type is a dilute alkali or alkaline earth metal hypochlorite solution. The most common types of such hypochlorite solutions are sodium hypochlorite and calcium hypochlorite. The second type of bleach is a peroxide solution (e.g. hydrogen peroxide solutions).

The above types of bleaching solutions and caustic scouring solutions may cause tendering of the cotton fiber due to oxidation which occurs in the presence of hot alkali or from the uncontrolled action of hypochlorite solutions during the bleaching process. Tendering can also occur during acid scours by the attack of the acid on the cotton fiber with the formation of hydrocellulose.

Accordingly, the prior art bleaching processes require extremely careful monitoring to obtain the desired degree of whiteness in the cotton fiber without fiber degradation. This is a difficult feat from a procedural standpoint and is viewed as a disadvantage. Further disadvantages of the prior art processes have been the necessity of thorough washing between each process step to avoid reprecipitation of dissolved impurities and the partial neutralization of chemical reagents which have been used. The aqueous waste streams and high energy requirement to remove the water from the bleached cotton fibers also present additional problem in today's economic climate.

SUMMARY OF THE INVENTION

We have now discovered a method of bleaching cotton which is superior to the prior art processes. Our novel process comprises contacting said cotton with a bleaching solution of chlorine monoxide ($Cl_2O$) in an inert liquid solvent. Bleaching occurs very rapidly at room temperature and there is very little if any degradation of the cotton fiber. The bleached cotton is generally of excellent white color.

Further advantages of the instant process accrue to the fact that the instant bleaching solution is an organic based system rather than an aqueous system.

Another advantage is the amenability of the instant process to a closed-loop type of system. The solvent can be easily recovered from the "spent" bleaching solution by conventional techniques (such as distillation) and reused many times. Additionally, residual solvent on the bleached cotton after the bleaching solution is drained away can be removed and later recovered by heating the bleached cotton with super heated vapors of a chlorinated solvent (ideally, the same solvent used in the bleaching solution—such as 1,1,1-trichloroethane or perchloroethylene). This is a conventional drying technique. This closed-loop process using organic solvents means no aqueous waste streams which must be decontaminated before discharge.

An additional advantage is a cost savings in the drying of the instantly bleached cotton. Less energy is required here than in the prior art processes which were water-soaked.

Other advantages will be readily apparent to those skilled in the art.

DETAILED DESCRIPTION OF THE INVENTION

Substantially all discolored cotton can be bleached (i.e. whitened) in the instant process. Its particular stage of processing does not appear to be particularly important. For example, raw cotton fibers can be used as well as cotton fibers which have been scoured and/or which have been carded and spun into yarns or even woven into textile fabrics. However, the instant process is particularly useful in bleaching raw cotton fibers since it tends to dewax the cotton fibers as well as bleaching them. This eliminates the need for a scouring step in many instances.

The bleaching solution in the instant process is a solution of chlorine monoxide dissolved in any one of several inert liquid solvents. As used herein, the term "inert liquid solvent" means a compound which will dissolve chlorine monoxide and which is inert to both the chlorine monoxide and to the cotton fiber. Examples of suitable such solvents include liquid halogenated and perhalogenated hydrocarbons (e.g. carbon tetrachloride, tetrachloroethylene, and the like), 1,1,1-trichloroethane, and the fluorinated hydrocarbon solvents known by the registered trademark of FREON, and other like compounds. Carbon tetrachloride and 1,1,1-trichloroethane are the preferred solvents with 1,1,1-trichloroethane being the most preferred solvent.

The amount of chlorine monoxide dissolved in the bleaching solution may be varied to convenience but normally is selected such that it is present in amounts of from about 0.1 to about 20 weight percent, based on the dry weight of the cotton. The lower concentrations are normally sufficient and are normally used (e.g. from about 0.1 to about 1 weight percent).

The moisture content of the cotton may be varied but is normally the equilibrium value at ambient conditions. No drying or humidification step is necessary.

The method of bleaching the cotton according to the instant process involves merely contacting the above bleaching solution with the cotton fiber. Bleaching is very rapid and occurs within a matter of from a few seconds up to a few minutes (e.g. up to about an hour) at ambient temperatures. Temperatures of from 0° up to the boiling point of the inert liquid solvent may be used but temperatures of from about 20° up to about 60° are preferred and ambient temperature is most preferred.

After the cotton is bleached, the bleaching solution is removed from the fiber by conventional techniques, normally by filtration under reduced pressure. The drying step involves merely heating the fiber at an elevated temperature to drive off any residual solvent.

This is normally done by using superheated vapors of a chlorinated hydrocarbon solvent (such as 1,1,1-trichloroethane) in the closed loop type processes which are conventional in dry cleaning. In this manner, the cotton fibers are dried and the solvent is recycled.

The instant process has a major advantage over prior art bleaching processes in that it can be conducted as a batch or a continuous closed-loop process in which all the solvents are recycled and recovered. This eliminates aqueous waste streams which are an ecological problem and an economic disadvantage. Additionally, the energy requirements to dry the cotton fiber are substantially less in the instant process than in the prior art processes which were totally aqueous.

The following examples further illustrate the invention.

EXAMPLES 1–24

Samples (1.0 g) of raw cotton sliver were added to 50 ml aliquots of various solutions of chlorine monoxide in carbon tetrachloride and the mixtures shaken for times and at temperatures specified in Table I below. The bleached cotton sliver thus produced was separated by filtration and oven-dried under vacuum (e.g. 20°–60° C/15 mm Hg).

The degree of bleaching was determined by comparing optical reflectance measurements made on the bleached and unbleached cotton sliver. Such measurements were conducted on discs prepared by placing 0.5 g of the cotton sample into a circular compression mold (0.75 inch diameter) and subjecting it to a ram pressure of 6000 psig for one minute. Optical reflectance measurements were then made on these discs using a Hunterlab Model D-40 Reflectometer with a "spot" size of 0.5 inch.

TABLE I

| Ex. | Percent Water | Percent $Cl_2O$ | Time (min.) | Temperature (° C) | Increase In Whiteness (%) |
|---|---|---|---|---|---|
| 1 | 10 | 0.0 | 5 | 20 | blank |
| 2 | 10 | 0.2 | 5 | 20 | 38.8 |
| 3 | 10 | 0.4 | 5 | 20 | 48.8 |
| 4 | 10 | 0.6 | 5 | 20 | 88.8 |
| 5 | 10 | 0.8 | 5 | 20 | 118.2 |
| 6 | 10 | 1.0 | 5 | 20 | 89.3 |
| 7 | 20 | 0.0 | 5 | 20 | blank |
| 8 | 20 | 0.2 | 5 | 20 | 38.7 |
| 9 | 20 | 0.4 | 5 | 20 | 57.0 |
| 10 | 20 | 0.6 | 5 | 20 | 70.4 |
| 11 | 20 | 0.8 | 5 | 20 | 100.0 |
| 12 | 20 | 1.0 | 5 | 20 | 85.2 |
| 13 | 20 | 0.0 | 15 | 20 | blank |
| 14 | 20 | 0.2 | 15 | 20 | 65.8 |
| 15 | 20 | 0.4 | 15 | 20 | 80.1 |
| 16 | 20 | 0.6 | 15 | 20 | 93.2 |
| 17 | 20 | 0.8 | 15 | 20 | 87.0 |
| 18 | 20 | 1.0 | 15 | 20 | 108.9 |
| 19 | 20 | 0.0 | 15 | 60 | blank |
| 20 | 20 | 0.2 | 15 | 60 | 22.1 |
| 21 | 20 | 0.4 | 15 | 60 | 109.9 |
| 22 | 20 | 0.6 | 15 | 60 | 112.2 |
| 23 | 20 | 0.8 | 15 | 60 | 147.3 |
| 24 | 20 | 1.0 | 15 | 60 | 187.8 |

The data under "Percent Water" and "Percent $Cl_2O$" represent the amount of water absorbed on the cotton sample and the weight percent of chlorine monoxide (based on dry cotton weight) in the chlorine monoxide/carbon tetrachloride solution, respectively. It was noted that only small amounts of the chlorine monoxide was consumed during the above experiments and that the solutions could be reused to bleach additional cotton stock. Similar results were achieved on cotton samples having more or less water content than those shown in the above examples.

EXAMPLES 25–28

In like manner, samples of raw cotton sliver (containing 10.6 percent water) were bleached by shaking them in 50 ml aliquots of solutions of 1.3 percent chlorine monoxide (based on dry cotton weight) in 1,1,1-trichloroethane at ambient temperature. The treatment (shaking) times and degree of bleaching are summarized in Table II.

TABLE II

| Ex. | Time (min.) | Increase In Whiteness (%) |
|---|---|---|
| 25 | 1 | 149 |
| 26 | 2 | 176 |
| 27 | 5 | 338 |
| 28 | 10 | 252 |

Similarly good results were achieved using other solutions of chlorine monoxide in 1,1,1-trichloroethane and at other temperatures and on raw cotton having other moisture contents.

We claim:

1. A method of bleaching cotton comprising contacting said cotton with a solution of chlorine monoxide in an inert liquid halogenated hydrocarbon solvent.

2. The method defined by claim 1 wherein said solvent is carbon tetrachloride or 1,1,1-trichloroethane.

3. The method defined by claim 1 wherein said solvent is 1,1,1-trichloroethane.

4. The method defined by claim 1 wherein said cotton is in the form of raw cotton fibers.

5. The method defined by claim 1 which additionally comprises the step of drying said cotton subsequent to bleaching.

6. The method defined by claim 1 wherein said chlorine monoxide is present in amounts of from about 0.1 to about 20 weight percent, based on the dry weight of the cotton.

7. The method defined by claim 6 wherein said chlorine monoxide is present in amounts of from about 0.1 to about 1 weight percent.

8. The method defined by claim 1 wherein the reaction temperature is from about 20° to about 60° C.

9. The method defined by claim 4 wherein said chlorine monoxide is present in amounts of from about 0.1 to about 1 weight percent, based on the dry weight of the cotton, and wherein the reaction temperature is from about 20° to about 60° C.

* * * * *